US006840772B1

(12) United States Patent
Pura

(10) Patent No.: US 6,840,772 B1
(45) Date of Patent: Jan. 11, 2005

(54) METHOD FOR THE IMPACT OR SHOT EVALUATION IN A SHOOTING RANGE AND SHOOTING RANGE

(75) Inventor: Rudolf Pura, Wetter (DE)

(73) Assignee: Dynamit Nobel GmbH Explosivstoff-und Systemtechnik, Troisdorf (DE)

( * ) Notice: Subject to any disclaimer, the term of this patent is extended or adjusted under 35 U.S.C. 154(b) by 0 days.

(21) Appl. No.: 09/959,880

(22) PCT Filed: Apr. 22, 2000

(86) PCT No.: PCT/EP00/03667

§ 371 (c)(1),
(2), (4) Date: Apr. 10, 2002

(87) PCT Pub. No.: WO00/70294

PCT Pub. Date: Nov. 23, 2000

(30) Foreign Application Priority Data

May 14, 1999 (DE) ..... 199 22 296
Mar. 10, 2000 (DE) ..... 100 11 311
Apr. 6, 2000 (DE) ..... 100 17 130

(51) Int. Cl.[7] ..... F41G 3/26

(52) U.S. Cl. ..... 434/21; 434/11; 434/23; 473/358; 703/7

(58) Field of Search ..... 434/11, 12, 16–23, 434/27, 365; 348/61, 363; 273/358, 371, 403; 703/7; 463/5; 345/7

(56) References Cited

U.S. PATENT DOCUMENTS 4,223,454 A * 9/1980 Mohon et al. ..... 434/20
4,276,028 A * 6/1981 Gwynn ..... 434/20
4,290,757 A * 9/1981 Marshall et al. ..... 434/12
4,336,018 A * 6/1982 Marshall et al. ..... 434/22
4,342,556 A * 8/1982 Hasse ..... 434/22
4,456,262 A * 6/1984 Palmen ..... 273/358
4,538,991 A * 9/1985 Simpson et al. ..... 434/12
4,611,993 A * 9/1986 Brown ..... 434/21
4,657,511 A * 4/1987 Allard et al. ..... 434/20
4,680,012 A * 7/1987 Morley et al. ..... 434/22
4,948,371 A * 8/1990 Hall ..... 434/21
5,215,463 A * 6/1993 Marshall et al. ..... 434/22
5,614,942 A * 3/1997 Rom ..... 348/61
5,816,817 A * 10/1998 Tsang et al. ..... 434/22
6,604,064 B1 * 8/2003 Wolff et al. ..... 703/7

FOREIGN PATENT DOCUMENTS

EP 1139058 A2 * 10/2001 ..... F41J/5/08

* cited by examiner

*Primary Examiner*—Joe H. Cheng
(74) *Attorney, Agent, or Firm*—Antonelli, Terry, Stout & Kraus, LLP

(57) ABSTRACT

The invention relates to a method for evaluating electronic impacts or shots of fired shots in a shooting range for sportsmen and for hunter training. The target to be shot at is provided as a light spot and is projected onto a target wall (1) via a light source in such a way that said target can move in all directions. An infrared camera (7) records the shooting image on the target wall (1) for evaluating the impact. The aim of the invention is to increase accuracy and reduce the evaluation time. Target co-ordinates arm detected while the target is being provided. Said target coordinates arm compared to the impact co-ordinates obtained by means of the impact evaluation. An impact is signalled when an impact falls short of a given divergence.

23 Claims, 1 Drawing Sheet

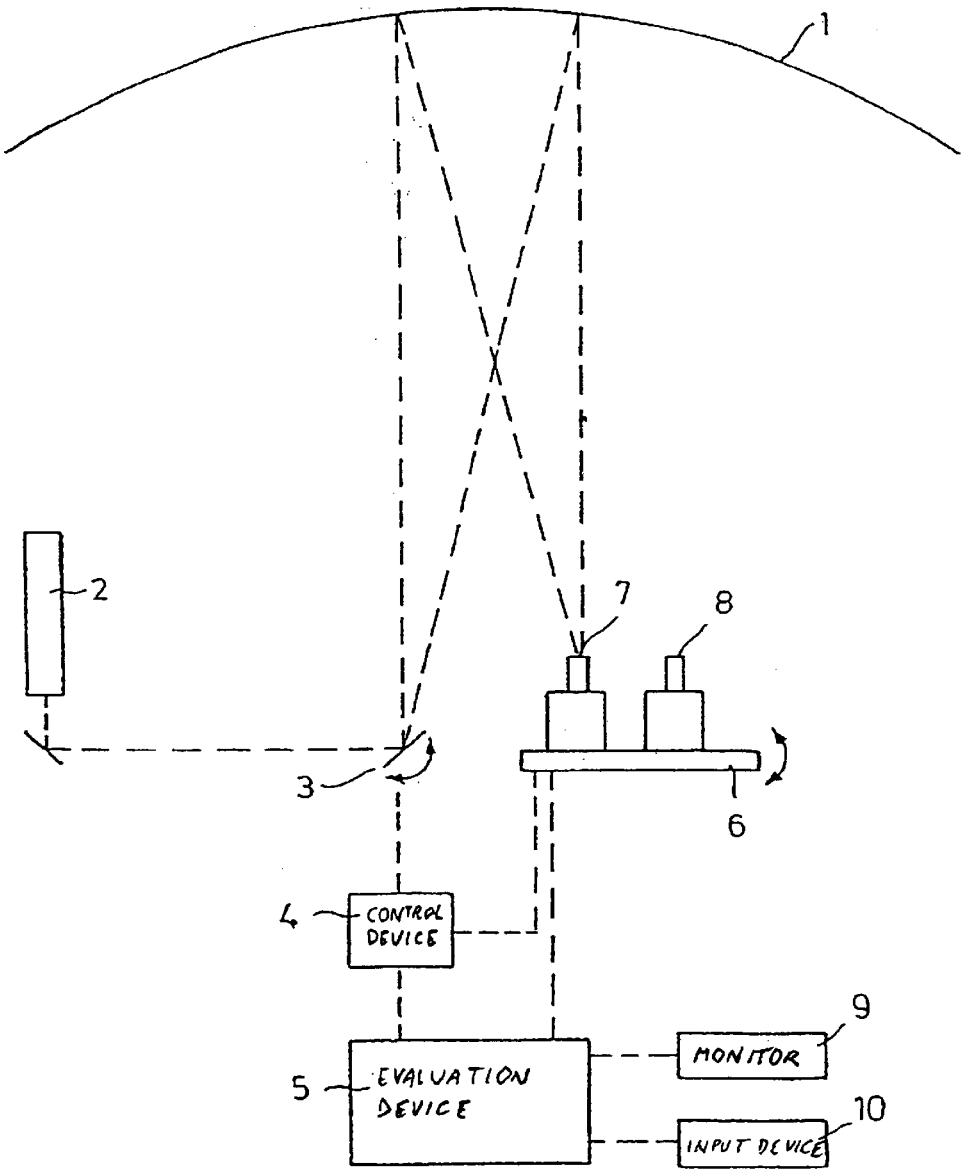
1
2
3
4
CONTROL DEVICE
5
EVALUATION DEVICE
6
7
8
9
MONITOR
10
INPUT DEVICE

METHOD FOR THE IMPACT OR SHOT EVALUATION IN A SHOOTING RANGE AND SHOOTING RANGE

BACKGROUND OF THE INVENTION

The invention relates to a method for electronic hit or shot evaluation of shots fired in a firing range for recreational shooting and hunt training, in which the target to be shot at is projected, on to a target wall as target output, via a light source as a bright spot movable in all directions and, for evaluating hits, an infrared camera produces a record of the shot image on the target wall, and relates to a firing range.

A method of this kind and firing range, is known from DE 37 29 613 C2. With this, the target wall is photographed by an infrared camera and, before the shot is fired, its image is written as a digital signal into the memory of a computer, in which it is available as a gray scale value, arranged in lines and columns. The coordinates of the light spot appearing on the target wall, as well as the image generated of the shot-at target wall after the shot has been fired, are stored in the computer and the gray scale values of the two images are then linked to one another. The coordinates of the changes established during linking are compared with the coordinates of the light spot at the time of the firing of the shot and the position of the shot at the target is determined.

A significant disadvantage of this firing range related to evaluation with an infrared camera is that, in this method a thermal image is regarded as an unchangeable static variable, however, this is not the case. A camera operating in a thermal range supplies a chronologically changing signal. The impacting low pulse energy soon disappears owing to the "self-generation" of the wall. A comparison of this kind is therefore completely unnecessary and can even lead to erroneous interpretation if the wall is not located immediately before the impact of the ammunition. However, this could be carried out only with several fixed infrared cameras, as the resolution of one camera for a target wall of typically more than 30 m distant is too low. The use of several infrared cameras is not possible on grounds of cost. Even with a moving camera this method cannot photograph the wall immediately after actuation of the acoustic switch and also before impact of the ammunition. To implement this the camera would have to stop moving in less than 78 ms and also file the image in the memory before the shot. This time is still essentially relatively short taking into consideration that the camera records the ammunition moving towards the wall much earlier.

The stated time relates to a slow small shot cartridge with a speed of $V_o$=400 m/s and a $V_{25}$ of 240 m/s at a distance of 25 m. The positioning of a moving camera with respect to a part surface of the wall required for evaluation and accuracy requires the photographing of many individual images. Because of the change in these individual images with time, in the comparison procedure the memory would first have to be updated before each new shot. One of these positions would first have to be covered after the firing, in order to achieve the necessary coincidence of the takes in this method. The evaluation time therefore also becomes longer by the travelling time taken to reach the next part surface. The evaluation time is therefore slower not only because of the larger amount of data, but also owing to the panning time. This means that the marksman cannot fire a second shot in quick succession if he misses. However, this is an important feature for the marksman. In addition larger intervals arise between each firing.

SUMMARY OF THE INVENTION

Therefore the object underlying the invention is to indicate a method and firing range for electronic hit or shot evaluation of shots fired in a firing range for recreational shooting and hunt training, in which the target to be shot at is projected onto a target wall as target output via a light source movable in all directions and, for hit evaluation, an infrared camera produces a shot image on the target wall, with which both great accuracy is achieved and evaluation time is reduced to such an extent that the marksman can fire two shots in succession without detriment.

According to the invention, this object with respect to the method, is achieved by recording the target coordinates at the same time as the target output, comparing these target coordinates with the hit coordinates obtained from the hit evaluation, and signaling a hit if they are below a predetermined divergence.

According to the invention, the above-mentioned object is achieved, with respect to the firing range, by the shooting range containing a device for measuring the heat pulses generated by the shot, with which the heat pulses generated by the heat build-up of the hits on the target well are immediately recorded as hit coordinates, and hit evaluation takes place in the evaluation device by comparing the target coordinates with the hit coordinates.

One advantage of this process and the firing range, inter alia, is that because of the lack of coincidence of the two photographs, before and after the shot, the mechanics can be far simpler. A small amount of overshooting at the time of taking the photograph can even be tolerated. This also makes the stopping time even shorter. Additionally a saving of time results because the amount of data to be processed is smaller.

Advantageously the target is stored in a control device in the form of target vectors or target coordinates and the target output is controlled by this control device via the light source. This means that the exact coordinates of the target are predetermined and known. A computer, for example, or else only a special insert card for a computer is suitable as control device. This can independently actuate the target output automatically, i.e. without involvement of the computer. In this way, after a shot has been fired, the target can continue to be outputted during the evaluation time (in a range of milliseconds) and action follows only after determining the result.

A laser is preferably used according to the invention as light source. For projection, the laser beam is directed on to a horizontally and vertically adjustable mirror, which diverts the laser beam and therefore the target on to the target wall. The movement of the mirror is controlled by the control device using the target coordinates. As a mirror is very light there are practically no errors in projection. A simple calibration to correlate the target coordinates with the mirror movement is sufficient.

The laser beam and therefore the target can naturally have any suitable shape and represent, for example, a hare or a pigeon. By modulation of the outline the motif also moves appropriately.

In a preferred embodiment, the infrared camera is arranged on a vertically and horizontally adjustable turntable, the movement of which is controlled by the control device as a function of the target coordinates. As, after the shot has been fired, a short time elapses until the shot hits the target wall, the movement of the turntable can be controlled in such a way that it takes this into account. Advantageously a certain lead is set.

Evaluation with a panning infrared line camera is a further embodiment. This camera is arranged in such a way that the line elements photograph a perpendicular line of the wall from top to bottom. After a small rotational movement which is aligned to the pulses per angle, one column is read in at a time by a pulse generator arranged on the horizontal axis. The reading in of a line/column lasts only microseconds. One column is therein written into the memory in one operation. The area is re-composed in the memory. The advantage of this arrangement is that the resolution is dependent only on the number of pulses per angle. It is therefore possible to achieve higher resolutions than with area cameras. Neither is the camera stopped to photograph a column, but goes on moving. Additionally the second rotational axis of the mirror is dispensed with. The range in which the marksman can miss, and yet a correct evaluation is possible, can therefore be greater because any number of columns can be read out. The only limitation is the computer's memory. Moreover, the evaluation time becomes longer.

According to the invention the infrared camera photographs the image of the shot after the shot has been fired and the digitalised image of the shot is evaluated in an evaluation device. As the movement of the turntable and therefore of the infrared camera is controlled by the control device, the coordinates are known. On firing, the shot particles (small shot or individual bullet) hit the target wall and generate heat pulses there. These heat pulses are photographed by the infrared camera and allocated to the hit coordinates.

Advantageously the target wall is a steel wall which has not been clad.

Calibration of the infrared camera is advantageously carried out with the aid of two markers outside the target wall. A property of the marker is that it must be able to give off heat. Any incandescent or halogen lamp is suitable. The marker can be detected by an infrared camera to align the central positions, with both mechanical alignment by precision adjustment and electronic calculation of the error position being possible.

If the laser is adjusted to the markers in a similar way by adjusting the intensification and offset of the mirrors, these can be determined even without optical checking of the laser position. If, for example, the marker is placed exactly in the centre of the camera aperture and if the above process has been correctly carried out, there is in each positions a direct connection between the deflecting voltage of the galvanometers associated with the laser, which are responsible for the mirror adjustment, and the voltage output on to the turntable. If the latter voltage is different this corresponds to an angle or a divergence from the position (an example: 0.01 volts correspond to 0.1 m on the wall). After a shot has been fired the camera moving forward stops. After, for example, 78 ms, which is the time that passes until the shot reaches the wall, the voltage on the rotating mirrors is digitally or analogously determined, as is the voltage responsible for guiding out the camera. If the divergence is, e.g. 0.01 volts on the horizontal axis, the laser dot is located, depending on the sign, exactly at this 0.1 m from the adjustment position.

The method and the firing range can, however, also be supplemented by a mechanically coupled optical camera, aligned in a similar way. This can either also determine the laser dot from the wall directly at the time the infrared camera takes its photograph or act as automatic check and monitoring of the correct adjustment.

BRIEF DESCRIPTION OF THE DRAWING

Further features of the invention emerge from the single FIGURE, which schematically shows the present invention.

DETAILED DESCRIPTION OF THE PREFERRED EMBODIMENTS

This FIGURE shows a target wall 1 of an approximate length of 42 m. The height is 3.50 m. In front of the target wall 1 is mounted an arrangement for the method of the invention, which arrangement is illustrated here only by way of example and schematically. The reference numeral 2 designates a laser.

The laser beam generated therein is directed via a movable mirror 3 on to the target wall 1 and there generates the target image, e.g. a running hare or a flying pigeon. An infrared camera 7 and a video camera 8 are arranged on a horizontally and vertically movable turntable 6.

The target coordinates are stored in a control device 4 in the form of a chronological sequence. The control device 4 then controls the mirror 3 and the turntable 6 and, during controlling, forwards the target coordinates to an evaluation device 5. The signals from the infrared camera 7 also arrive in this evaluation device 5. Since the coordinates of the target image are known, the coordinates of the image of the infrared camera 7 are also known. Thus both the target coordinates and the hit coordinates are present. If a predetermined divergence is not reached, a hit is signalled, e.g. on a monitor 9. An input device is designated by the reference numeral 10. As described, the video camera 8 on the turntable 6 serves to calibrate the shooting range.

It can be advantageous to work out the hit coordinates from two successive photographs of the shot image with special infrared cameras.

As an example of this, the first photograph of the shot image is taken at the time of the impact of the hit and the second photograph 0.033 seconds later. The two photographs show a temperature difference. This can be involved in working out the hit coordinates.

What is claimed is:

1. Method for electronic hit or shot evaluation of shots fired in a firing range for recreational shooting and hunt training, comprising projecting a target to be shot at on to a target wall as target output via a light source movable in all directions, conducting a hit evaluation by producing a photograph of the shot image of heat pulses generated by at least one shot particle hitting the target wall with an infrared camera, recording target coordinates at the same time as the target output, comparing the target coordinates with the hit coordinates obtained from the hit evaluation, and signaling a hit if the target coordinates and the hit coordinates are below a predetermined divergence.

2. Method according to claim 1, wherein the target is stored in a control device in the form of target vectors or target coordinates and the target output is controlled by this control device via the light source.

3. Method according to claim 1, wherein the light source is a laser.

4. Method according to claim 1, wherein the infrared camera is arranged on an adjustable turntable, the movement of which is controlled by the control device as a function of the target coordinates.

5. Method according to claim 4, wherein, for calibrating the movement of the turntable or the hit coordinates, a video camera is additionally arranged on the turntable via which the coordinates of predetermined targets on the target wall are recorded.

6. Method according to claim 1, wherein, after the shot has been fired, the infrared camera photographs the shot image to produce a digitized shot image and the digitized shot image is evaluated in an evaluation device, wherein the heat pulses generated by the heat buildup of the hits on the target wall are allocated to the hit coordinates.

7. Method according to claim 1, wherein the infrared camera is a line camera.

8. Method according to claim 1, wherein the hit coordinates are evaluated from two successive photographs of the shot image.

9. Method for electronic hit or shot evaluation of shots fired in a firing, range for recreational shooting and hunt training, comprising projecting a target to be shot at on to a target wall made of steel as target output via a light source movable in all directions, conducting a hit evaluation by producing a photograph of the shot image of heat pulses generated by at least one shot particle hitting the target wall with an infrared camera, recording target coordinates at the same time as the target output comparing the target coordinates with the hit coordinates obtained from the hit evaluation, and signaling a hit if the target coordinates and the hit coordinates are below a predetermined divergence.

10. Method according to claim 9, wherein the at least one shot particle comprises small shot particles.

11. Method according to claim 9, wherein the at least one shot particle comprises an individual bullet.

12. Firing range for electronic hit or shot evaluation of shots fired, comprising:

a target wall;

a light source, movable in all directions, for generating the target to be shot at according to target coordinates;

a device for measuring heat pulses generated by the shot, with which the heat pulses generated by the heat build-up of the hits of at least one shot particle on the target wall are immediately recorded as hit coordinates; and an evaluation device for comparing the target coordinates with the hit coordinates.

13. Firing range according to claim 12, wherein the device for measuring the heat pulses generated by the shot is an infrared camera.

14. Firing range according to claim 13, wherein the infrared camera is arranged on an adjustable turntable, the movement of which is controlled by a control device as a function of the target coordinates.

15. Firing range according to claim 14, wherein, for calibrating the movement of the turntable or the hit coordinates, a video camera by means of which the coordinates of predetermined targets on the target wall are recorded, is arranged on the turntable.

16. Firing range according to claim 13, wherein, after the shot has been fired, the infrared camera photographs the shot image to produce a digitized shot image and the digitized shot image is evaluated in the evaluation device, with the heat pulses generated by the heat buildup of the hits on the target wall being allocated to the hit coordinates.

17. Firing range according to claim 13, wherein the infrared camera records the tilt coordinates by photographing two successive shot images.

18. Firing range according to claim 12, wherein the target is stored in a control device in the form of target vectors or target coordinates and the control device controls the target via the light source.

19. Firing range according to claim 12, wherein the light source is a laser.

20. Firing range according to claim 12, wherein the infrared camera is a line camera.

21. Firing range for electronic hit or shot evaluation of shots fired, comprising:

a target wall made of steel;

a light source movable in all directions for generating the target to be shot at according to target coordinates;

a device for measuring heat pulses generated by the shot, with which the heat pulses generated by the heat build-up of the hits of at least one shot particle on the target wall are immediately recorded as hit coordinates; and an evaluation device for comparing the target coordinates with the hit coordinates.

22. Firing range according to claim 21, wherein the at least one shot particle comprises small shot particles.

23. Firing range according to claim 21, wherein the at least one shot comprises an individual bullet.

* * * * *